US007208075B2

(12) United States Patent
Strezov et al.

(10) Patent No.: US 7,208,075 B2
(45) **Date of Patent: *Apr. 24, 2007**

(54) REDUCTION OF METAL OXIDES IN AN ELECTROLYTIC CELL

(75) Inventors: Lazar Strezov, Adamstown (AU); Ivan Ratchev, Georgetown (AU); Steve Osborn, Valentine (AU)

(73) Assignee: BHP Billiton Innovation Pty Ltd. (AU)

( * ) Notice: Subject to any disclaimer, the term of this patent is extended or adjusted under 35 U.S.C. 154(b) by 39 days.

This patent is subject to a terminal disclaimer.

(21) Appl. No.: 10/637,548

(22) Filed: Aug. 11, 2003

(65) Prior Publication Data

US 2004/0026262 A1 Feb. 12, 2004

Related U.S. Application Data

(63) Continuation of application No. 10/175,348, filed on Jun. 20, 2002, now Pat. No. 6,663,763.

(30) Foreign Application Priority Data

Mar. 13, 2002 (AU) ..... PS1071

(51) Int. Cl.
*C25C 3/28* (2006.01)

(52) U.S. Cl. ..... 205/367; 205/397

(58) Field of Classification Search ..... 205/367–371, 205/397–401, 354; 204/243.1
See application file for complete search history.

(56) References Cited

U.S. PATENT DOCUMENTS

| | | | | |
|---|---|---|---|---|
| 4,225,395 | A | 9/1980 | Tsang | |
| 4,581,065 | A | 4/1986 | Orgera | |
| 5,976,345 | A * | 11/1999 | Pal et al. | 205/336 |
| 6,299,742 | B1 | 10/2001 | Pal et al. | |
| 6,540,902 | B1 | 4/2003 | Redey et al. | |

FOREIGN PATENT DOCUMENTS

| | | |
|---|---|---|
| DE | 150557 | 6/1903 |
| GB | 2 359 564 A | 8/2001 |

(Continued)

OTHER PUBLICATIONS

Chen et al., Direct Electrochemical Reduction of Titanium Dioxide to Titanium in Molten Calcium Chloride, Sep. 21, 2000, Nature 407, 361-364.*

(Continued)

*Primary Examiner*—Roy King
*Assistant Examiner*—Michael P. Alexander
(74) *Attorney, Agent, or Firm*—Miles & Stockbridge P.C.; Edward J. Kondracki

(57) ABSTRACT

A method of reducing a metal oxide in a solid state, in an electrolytic cell, is provided, as is an electrolytic cell suitable for performing the method. The cathode of the electrolytic cell is formed at least in part from the metal oxide to be reduced, and the electrolyte includes cations of a metal that is capable of chemically reducing the cathode metal oxide. The method includes operating the cell at a potential that is above the potential at which cations of the reducing metal will deposit as metal on the cathode.

6 Claims, 6 Drawing Sheets

Schematic of the experimental set up

FOREIGN PATENT DOCUMENTS

WO WO 9964638 A1 12/1999

OTHER PUBLICATIONS

"Studies in the Electrolytic Reduction of Titanium Dioxide and Titanium Slag", S. Takeuchi et al. Nippon Kinzoku Gakkaishi, vol. 28, No. 9, pp. 549-554 (circa 1964).

"Electrochemical Deoxidation of Titanium" Mellurgical Transactions B, vol. 24B, Jun. 1993 Okabe t al., pp. 449-455.

"Reduction of Titanium Dioxide by Calcium in Hot Cathode Spot" Oki et al., Memoirs of the School of Engineering, Nagoya University, vol. 19, No. 1 (1967).

* cited by examiner

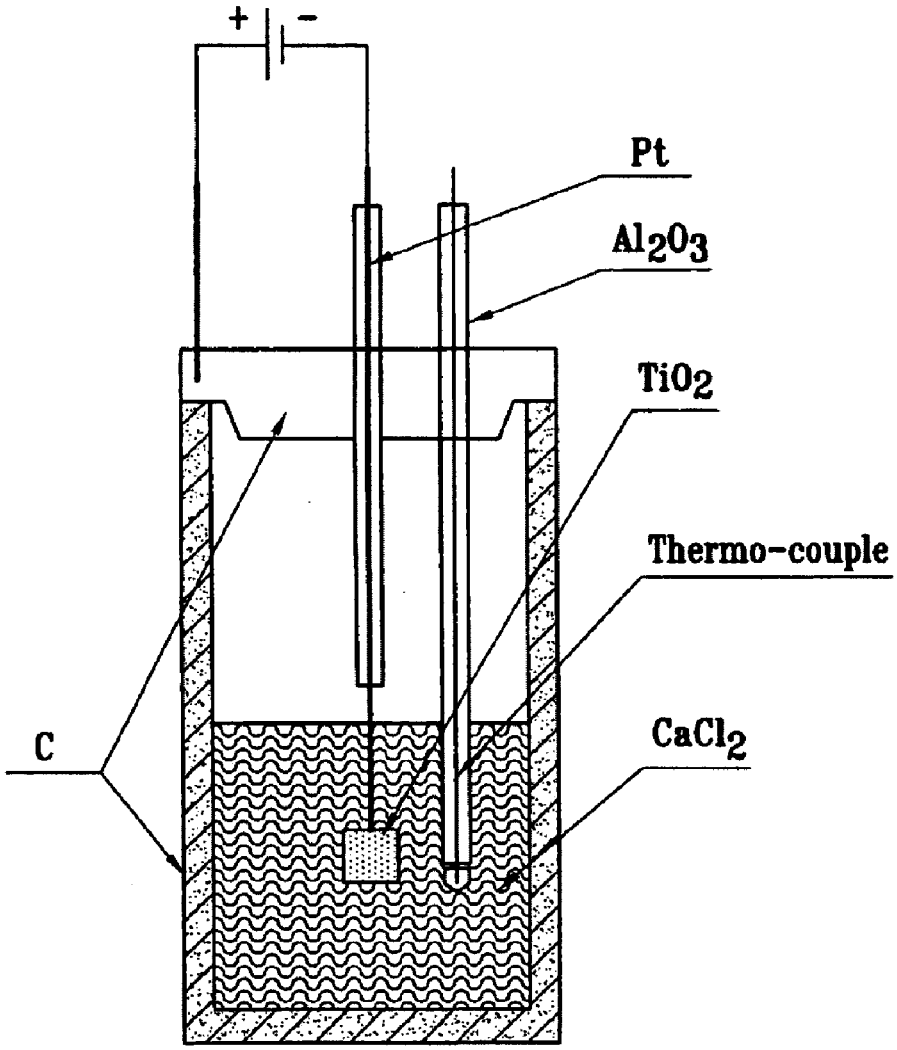
Fig. 1 Schematic of the experimental set up

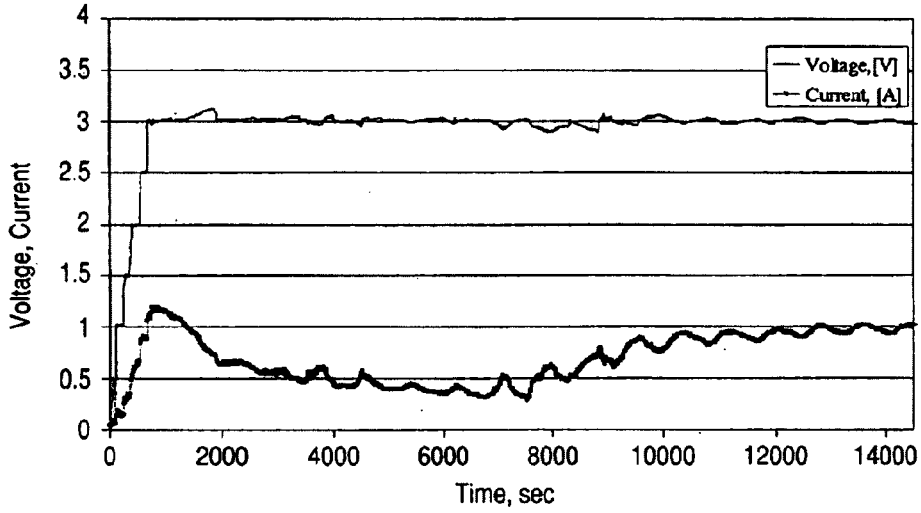
Fig 2. Variation of the applied potential and current during the run
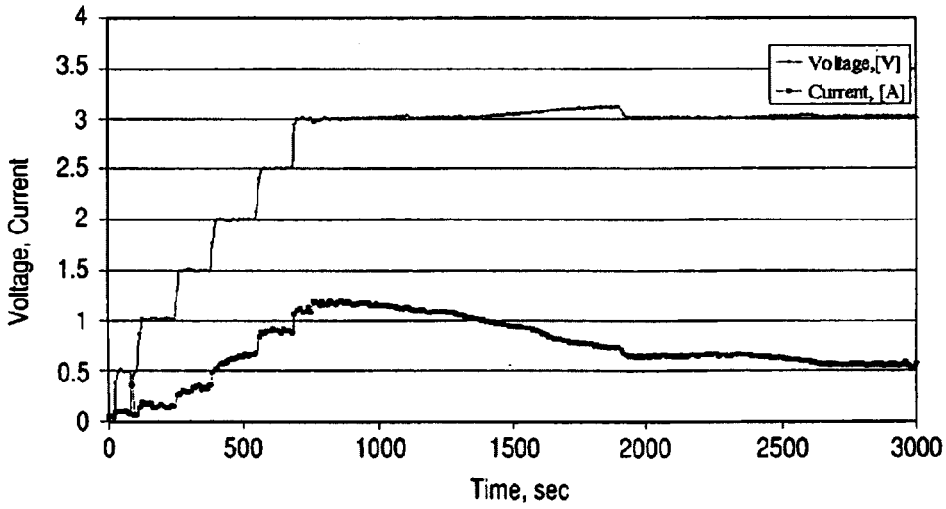
Fig 3. Variation of the applied potential and current in the initial stage of the run

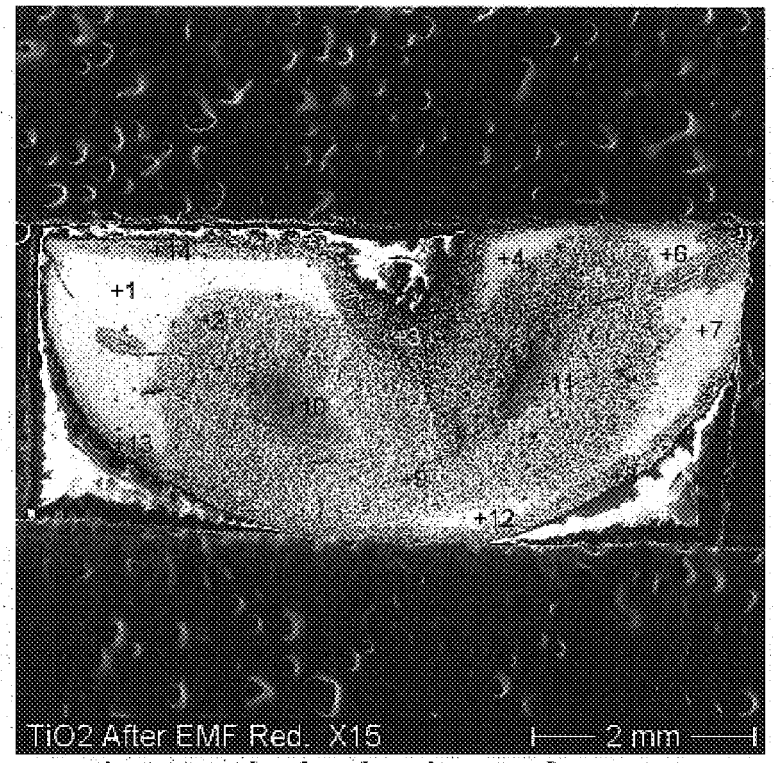
Fig 4. SEM image of the horizontal cross-section of Pellet 1 after the run
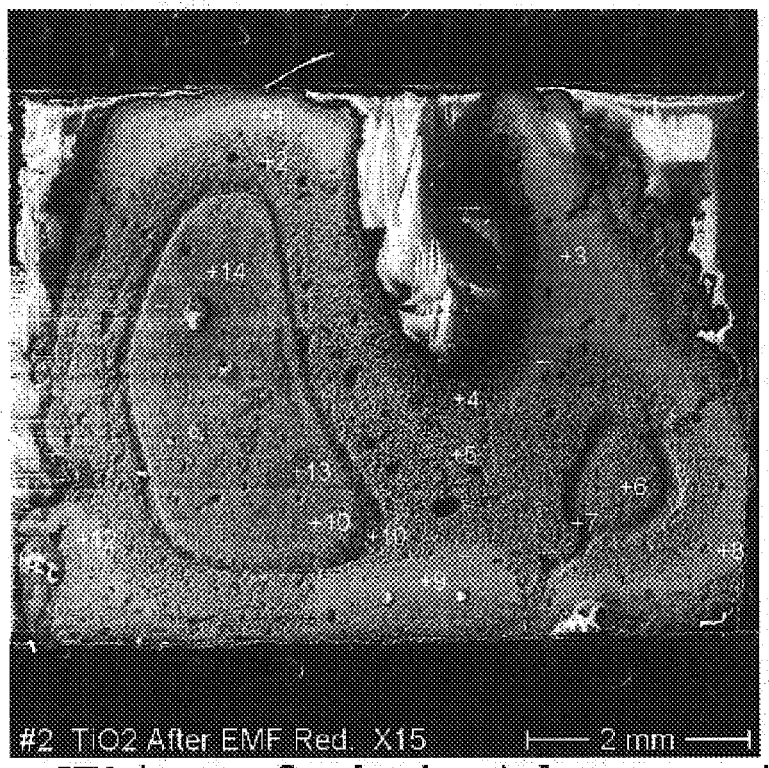
Fig. 5. SEM image of a horizontal cross-section of Pellet 2 after the run

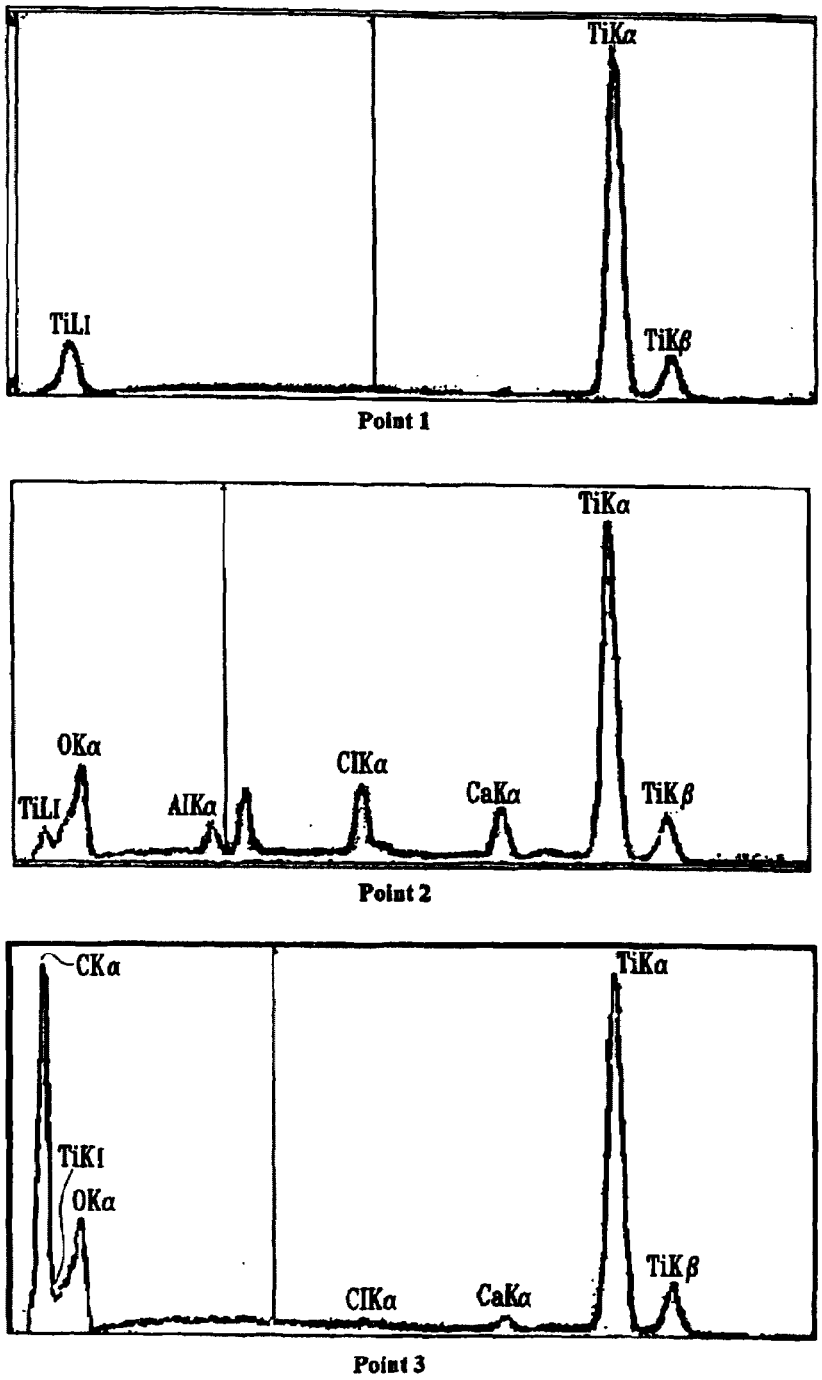
Fig. 6. EPMA analysis of Pellet 1 (Pressed)

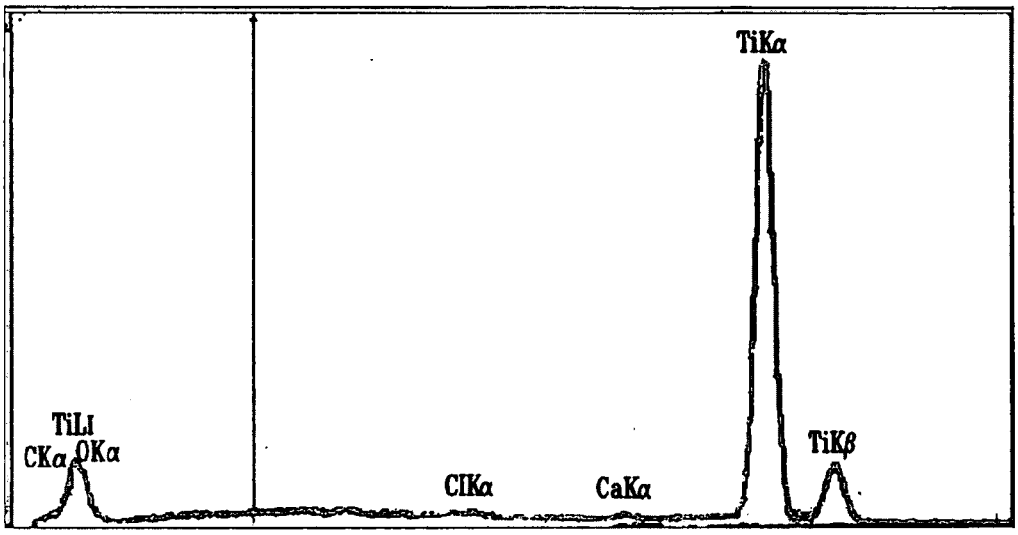
Point 1
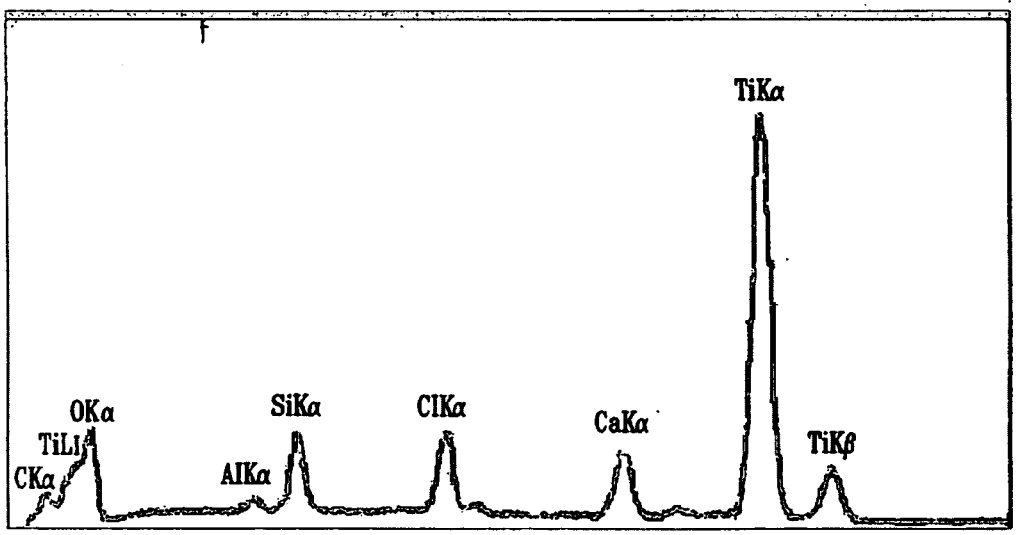
Point 2
Fig. 7. EPMA analysis of Pellet 2 (Slip-cast) - Part 1

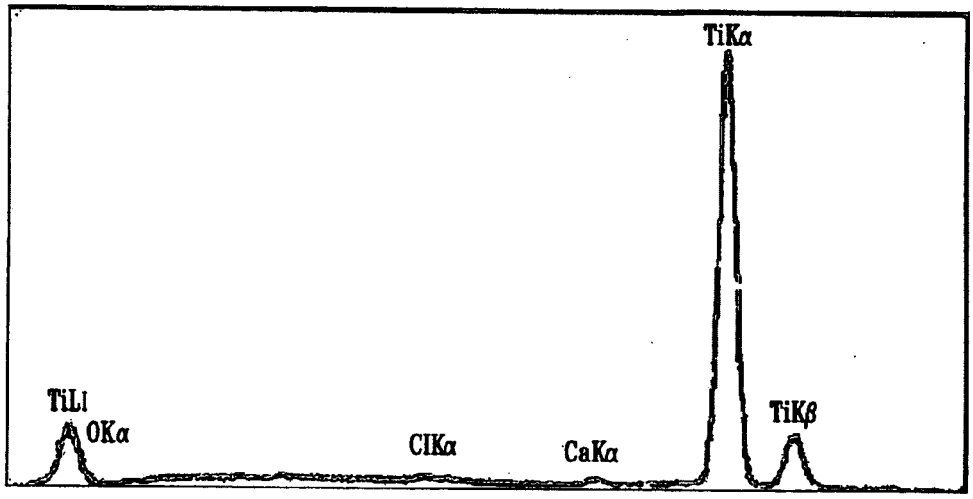
Point 3
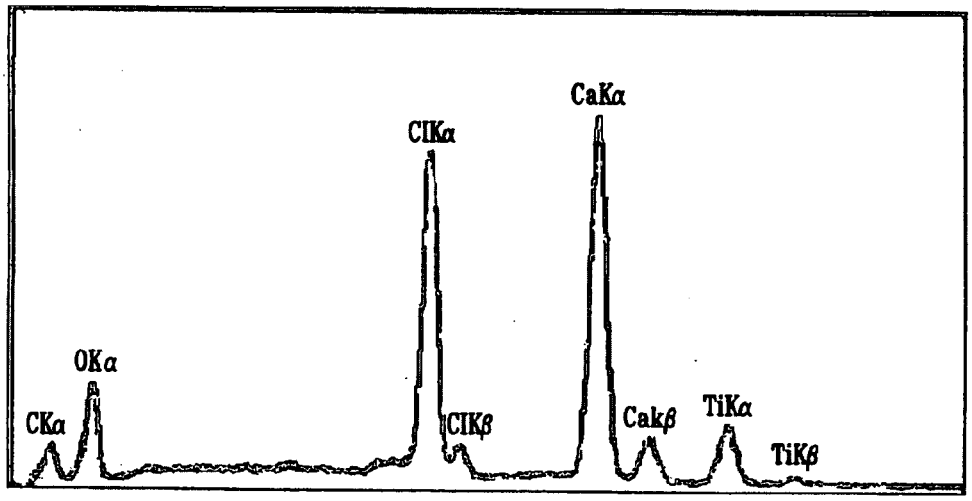
Point 14
Fig. 7. EPMA analysis of Pellet 2 (Slip-cast) - Part 2

REDUCTION OF METAL OXIDES IN AN ELECTROLYTIC CELL

CROSS REFERENCE TO RELATED APPLICATION

This is a continuation of Application No. 10/175,348, filed on Jun. 20, 2002, now U.S. Pat. No. 6,663,763.

BACKGROUND OF THE INVENTION

1. Field of the Invention

The present invention relates to reduction of metal oxides in an electrolytic cell.

2. Description of Related Art

The present invention was made during the course of an on-going research project on the electrolytic reduction of titania ($TiO_2$) carried out by the applicant.

During the course of the research project the applicant carried out experimental work on an electrolytic cell that included a graphite crucible that formed an anode of the cell, a pool of molten $CaCl_2$-based electrolyte in the crucible, and a cathode that included solid titania.

One objective of the experimental work was to reproduce the results reported in International application PCT/GB99/01781 (Publication no. WO99/64638) in the name of Cambridge University Technical Services Limited and in technical papers published by the inventors.

The Cambridge International application discloses two potential applications of a "discovery" in the field of metallurgical electrochemistry.

One application is the direct production of a metal from a metal oxide.

In the context of this application, the "discovery" is the realisation that an electrolytic cell can be used to ionise oxygen contained in a metal oxide so that the oxygen dissolves in an electrolyte. The Cambridge International application discloses that when a suitable potential is applied to an electrolytic cell with a metal oxide as a cathode, a reaction occurs whereby oxygen is ionised and is subsequently able to dissolve in the electrolyte of the cell.

European patent application 9995507.1 derived from the Cambridge International application has been allowed by the European Patent Office.

The allowed claims of the European patent application inter alia define a method of electrolytically reducing a metal oxide (such as titania) that includes operating an electrolytic cell at a potential that is lower than the deposition potential of cations in the electrolyte.

The Cambridge European patent application does not define what is meant by deposition potential and does not include any specific examples that provide values of the deposition potential for particular cations.

However, submissions dated 2 Oct. 2001 to the European Patent Office by the Cambridge patent attorneys, which pre-dated the lodgement of the claims that were ultimately allowed, indicate that they believe that the decomposition potential of an electrolyte is the deposition potential of a cation in the electrolyte.

Specifically, page 5 of the submissions state that: "The second advantage described above is achieved in part through carrying out the claimed invention below the decomposition potential of the electrolyte. If higher potentials are used then, as noted in D1 and D2, the cation in the electrolyte deposits on the metal or semi-metal compound. In the example of D1, this leads to calcium deposition and therefore consumption of this reactive metal . . . During operation of the method, the electrolytic cation is not deposited on the cathode".

Contrary to the findings of Cambridge, the experimental work carried out by the applicant has established that it is essential that the electrolytic cell be operated at a potential that is above the potential at which $Ca^{++}$ cations in the electrolyte can deposit as Ca metal on the cathode.

SUMMARY OF THE INVENTION

Accordingly, the present invention provides a method of reducing a metal oxide in a solid state in an electrolytic cell, which electrolytic cell includes an anode, a cathode formed at least in part from the metal oxide, and a molten electrolyte, the electrolyte including cations of a metal that is capable of chemically reducing the cathode metal oxide, and which method includes a step of operating the cell at a potential that is above a potential at which cations of the metal that is capable of chemically reducing the cathode metal oxide deposit as the metal on the cathode, whereby the metal chemically reduces the cathode metal oxide.

The applicant does not have a clear understanding of the electrolytic cell mechanism at this stage. Nevertheless, whilst not wishing to be bound by the comments in this paragraph, the applicant offers the following comments by way of an outline of a possible cell mechanism. The experimental work carried out by the applicant produced evidence of Ca metal in the electrolyte. The applicant believes that, at least during the early stages of operation of the cell, the Ca metal was the result of electrodeposition of $Ca^{++}$ cations as Ca metal on electrically conductive sections of the cathode. The experimental work was carried out using a $CaCl_2$-based electrolyte at a cell potential below the decomposition potential of $CaCl_2$. The applicant believes that the initial deposition of Ca metal on the cathode was due to the presence of $Ca^{++}$ cations and $O^{--}$ anions derived from CaO in the electrolyte. The decomposition potential of CaO is less than the decomposition potential of $CaCl_2$. In this cell mechanism the cell operation is dependent at least during the early stages of cell operation on decomposition of CaO, with $Ca^{++}$ cations migrating to the cathode and depositing as Ca metal and $O^{--}$ anions migrating to the anode and forming CO and/or $CO_2$ (in a situation in which the anode is a graphite anode). The applicant believes that the Ca metal that deposited on electrically conductive sections of the cathode was deposited predominantly as a separate phase in the early stages of cell operation and thereafter dissolved in the electrolyte and migrated to the vicinity of the titania in the cathode and participated in chemical reduction of titania. The applicant also believes that at later stages of the cell operation part of the Ca metal that deposited on the cathode was deposited directly on partially deoxidised titanium and thereafter participated in chemical reduction of titanium. The applicant also believes that the $O^{--}$ anions, once extracted from the titania, migrated to the anode and reacted with anode carbon and produced CO and/or $CO_2$ and released electrons that facilitated electrolytic deposition of Ca metal on the cathode.

Preferably the metal deposited on the cathode is soluble in the electrolyte and can dissolve in the electrolyte and thereby migrate to the vicinity of the cathode metal oxide.

In a situation in which the metal oxide is a titanium oxide, such as titania, it is preferred that the electrolyte be a $CaCl_2$-based electrolyte that includes CaO as one of the constituents of the electrolyte.

In such a situation it is preferred that the cell potential be above the potential at which Ca metal can deposit on the cathode, i.e. the decomposition potential of CaO.

The decomposition potential of CaO can vary over a considerable range depending on factors such as the composition of the anode, the electrolyte temperature and electrolyte composition.

In a cell containing CaO saturated $CaCl_2$ at 1373K (1100° C.) and a graphite anode this would require a minimum cell potential of 1.34V.

It is also preferred that the cell potential be below the potential at which $Cl^-$ anions can deposit on the anode and form chlorine gas, i.e. the decomposition potential of $CaCl_2$.

In a cell containing CaO saturated $CaCl_2$ at 1373K (1100° C.) and a graphite anode this would require that the cell potential be less than 3.5V.

The decomposition potential of $CaCl_2$ can vary over a considerable range depending on factors such as the composition of the anode, the electrolyte temperature and electrolyte composition.

For example, a salt containing 80% $CaCl_2$ and 20% KCl at a temperature of 900K (657° C.), decomposes to Ca (metal) and $Cl_2$ (gas) above 3.4V and a salt containing 100% $CaCl_2$ at 1373K (1100° C.) decomposes at 3.0V.

In general terms, in a cell containing CaO—$CaCl_2$ salt (not saturated) at a temperature in the range of 600–1100° C. and a graphite anode it is preferred that the cell potential be between 1.3 and 3.5V.

The $CaCl_2$-based electrolyte may be a commercially available source of $CaCl_2$, such as calcium chloride dihydrate, that partially decomposes on heating and produces CaO or otherwise includes CaO.

Alternatively, or in addition, the $CaCl_2$-based electrolyte may include $CaCl_2$ and CaO that are added separately or pre-mixed to form the electrolyte.

It is preferred that the anode be graphite or an inert anode.

The applicant found in the experimental work that there were relatively significant amounts of carbon transferred from the graphite anode to the electrolyte and to a lesser extent, to the titanium produced at the cathode under a wide range of cell operating conditions. Carbon in the titanium is an undesirable contaminant. In addition, carbon transfer was partially responsible for low energy efficiency of the cell. Both problems could present significant barriers to commercialisation of electrolytic reduction technology.

The applicant also found that the dominant mechanism of carbon transfer is electrochemical rather than erosion and that one way of minimising carbon transfer and therefore contamination of titanium produced at the cathode by electrolytic reduction of titania is to position a membrane that is permeable to oxygen anions and is impermeable to carbon in ionic and non-ionic forms between the cathode and the anode and thereby prevent migration of carbon to the cathode.

Accordingly, in order to minimise contamination of titanium produced at the cathode resulting from carbon transfer, it is preferred that the electrolytic cell includes a membrane that is permeable to oxygen anions and is impermeable to carbon in ionic and non-ionic forms positioned between the cathode and the anode to thereby prevent migration of carbon to the cathode.

The membrane may be formed from any suitable material.

Preferably the membrane is formed from a solid electrolyte.

One solid electrolyte tested by the applicant is yttria stabilised zirconia.

According to the present invention there is also provided an electrolytic cell as described above and operating in accordance with the above described method.

BRIEF DESCRIPTION OF THE DRAWINGS

FIG. 1 is a schematic view of an electrolytic cell employed in demonstrating the present invention.

FIGS. 2 and 3 are graphs showing the variation of applied potential and current during an experimental run and in the initial stage of the experimental run.

FIGS. 4 and 5 are SEM images of cross-sections of two pellets in the experiment.

FIGS. 6 and 7 are graphs of the results of EPMA analysis of the pellets.

DETAILED DESCRIPTION OF THE PREFERRED EMBODIMENT

The present invention is described further with reference to the following example.

I. Experimental Method and Electrolytic Cell

The electrolytic cell is shown in FIG. 1.

With reference to FIG. 1, the electrochemical cell included a graphite crucible equipped with a graphite lid. The crucible was used as the cell anode. A stainless steel rod was used to secure electrical contact between a d/c power supply and the crucible. The cell cathode consisted of Kanthal or platinum wire connected at one end to the power supply and $TiO_2$ pellets suspended from the other end of the wire. An alumina tube was used as an insulator around the cathode. The cell electrolyte was a commercially available source of $CaCl_2$, namely calcium chloride dihydrate, that partially decomposed on heating at the operating temperature of the cell and produced CaO. A thermocouple was immersed in the electrolyte in close proximity to the pellets.

Two types of pellets were used. One type was slip-cast and the other type was pressed. Both types of pellets were made from analytical grade $TiO_2$ powder. Both types of pellets were sintered in air at 850° C. One pressed and one slip-cast pellet were used in the experiment.

The cell was positioned in a furnace and the experiment was conducted at 950° C. Voltages up to 3V. were applied between the crucible wall and the Kanthal or platinum wire. The voltage of 3V is below the potential at which $Cl^-$ anions can deposit on the anode at that temperature.

The power-supply maintained a constant voltage throughout the experiment. The voltage and resulting cell current were logged using LabVIEW (TM) data acquisition software.

At the end of the experiment the cell was removed from the furnace and quenched in water. The solid $CaCl_2$ was dissolved by water and the two pellets were recovered.

II. Experimental Results

With reference to FIGS. 2 and 3, the constant voltage (3V) used in the experiment produced an initial current of approximately 1.2 A. A continuous drop in the current was observed during the initial 2 hours. After that a gradual increase in the current up to 1 A was observed.

SEM images of the cross-sections of the two recovered pellets are shown in FIGS. 4 and 5. The SEM images indicate the presence of metallic titanium in both pellets.

The presence of virtually pure metallic titanium in both pellets was confirmed by EPMA analysis. The analysis also showed areas of partially reduced titania. The EPMA results are shown in FIGS. 6 and 7.

Carbon was detected at various locations within the pellets and its content varied up to 18 wt %.

Many modifications may be made to the present invention as described above without departing from the the spirit and scope of the invention.

By way of example, whilst the above description of the invention focuses on reduction of titania, the invention is not so limited and extends to reduction of other titanium oxides and to oxides of other metals and alloys. Examples of other potentially important metals are aluminium, silicon, germanium, zirconium, hafnium, magnesium and molybdenum.

Furthermore, whilst the above description focuses on $CaCl_2$-based electrolyte, the invention is not so limited and extends to any other suitable electrolytes (and mixtures of electrolytes). Generally, suitable electrolytes will be salts and oxides that are soluble in salts. One example of a potentially suitable electrolyte is $BaCl_2$.

The invention claimed is:

1. A method of reducing a metal oxide in a solid state in an electrolytic cell, which electrolytic cell includes an anode, a cathode formed at least in part from the metal oxide, and a molten electrolyte, the electrolyte including cations of a metal that is capable of chemically reducing the cathode metal oxide, and which method includes a step of operating the cell at a potential that is above a potential at which cations of the metal that is capable of chemically reducing the cathode metal oxide deposit as the metal on the cathode, whereby the metal chemically reduces the cathode metal oxide.

2. The method defined in claim 1 wherein the metal deposited on the cathode is soluble in the electrolyte and can dissolve in the electrolyte and thereby migrate to the vicinity of the cathode metal oxide.

3. The method defined in claim 2 wherein the electrolyte is a commercially available source of $CaCl_2$ that forms CaO on heating or otherwise includes CaO.

4. The method defined in claim 2 wherein the electrolyte includes $CaCl_2$ and CaO that are added separately or pre-mixed to form the electrolyte.

5. The method defined in claim 1 wherein the anode is graphite.

6. The method defined in claim 1 wherein the anode is graphite and the electrolytic cell includes a membrane that is permeable to oxygen anions and is impermeable to carbon in ionic and non-ionic forms positioned between the cathode and the anode to thereby prevent migration of carbon to the cathode.

* * * * *